US005603519A

United States Patent [19]

Conte

[11] Patent Number: 5,603,519

[45] Date of Patent: Feb. 18, 1997

[54] DEVICE FOR VARYING THE ALIGNMENT OF WHEELS, PARTICULARLY FOR IN-LINE SKATES

[75] Inventor: Gino Conte, Caerano San Marco, Italy

[73] Assignee: Roces S.R.L., Montebelluna, Italy

[21] Appl. No.: 402,841

[22] Filed: Mar. 13, 1995

[30] Foreign Application Priority Data

Apr. 12, 1994 [IT] Italy ..... MI94A0675

[51] Int. Cl.[6] ..... A63C 17/00

[52] U.S. Cl. ..... 280/11.22

[58] Field of Search ..... 280/11.19, 11.2, 280/11.22, 11.23, 11.27, 11.28, 11.26, 809, 811, 816, 825

[56] References Cited

FOREIGN PATENT DOCUMENTS

92/10251 6/1992 WIPO ..... 280/11.22

*Primary Examiner*—Richard M. Camby
*Assistant Examiner*—Frank Vanaman
*Attorney, Agent, or Firm*—McAulay Fisher Nissen Goldberg & Kiel, LLP

[57] ABSTRACT

A device for varying the vertical alignment of wheels, for in-line skates includes a U-shaped frame having wings provided with at least two mutually aligned wheels. The device is constituted by a support having two second wheels. The support is selectively associable with the frame at individually different heights.

10 Claims, 5 Drawing Sheets

DEVICE FOR VARYING THE ALIGNMENT OF WHEELS, PARTICULARLY FOR IN-LINE SKATES

BACKGROUND OF THE INVENTION

1. Field of the invention

The present invention relates to a device for varying the alignment of wheels, particularly for in-line skates.

2. Description of the Prior Art

Conventional in-line skates are constituted by a shoe associated with a usually U-shaped frame. A plurality of wheels are pivoted between the wings of the frame and are thus mutually aligned.

A problem in the use of these skates is that it is not easy to achieve a quick change in direction owing to the parallel arrangement of all the wheels, with respect to the ground, the wheels may be as many as four or five.

This problem becomes evident in the user's need to have two structurally different skates: for slalom or for speed skating.

U.S. Pat. No. 2,412,290 offers a partial solution to this drawback and discloses a skate having a frame with three aligned wheels; the intermediate wheel is vertically adjustable to facilitate the maneuverability of the skate.

However, this solution is structurally complicated, because the vertical adjustment of the intermediate wheel can be achieved by means of a fixing bolt and a system of meshing teeth to produce the desired vertical adjustment.

U.S. Pat. No. 3,287,023 discloses a roller skate wherein, at the front and at the rear parts of the frame, there are seats at different heights for the arrangement of the rear and front wheels, which can thus be raised from the ground to varying extents.

Even this solution, however, is not optimum, because in order to vary the arrangement of the wheels it is necessary to disconnect them from the frame and reposition them in the desired point.

This entails long execution times and the possibility that the operator may lose a component if he first disassembles the wheels and then reassembles them.

U.S. Pat. No. 5,048,848 discloses a roller skate with aligned wheels that has bushes for axial openings for simplified installation. Slots are in fact formed on the wings of the frame of the skate so that the axis of the slots is at right angles to the ground. Bushes provided with eccentric holes can be temporarily placed within these slots; the arrangement of these bushes in positions, which are 180° with respect to each other, inside these openings allows to place the pivot of the central wheels at a slightly lower level than the front and rear wheels, so as to improve curving.

Even this solution, however, is not free from drawbacks: first of all, in order to vary the elevation of the central wheels it is necessary for each wheel, to disengage the two bushes from the respective openings, rotate them, place them back in the openings, reposition the wheel in its place, reinsert the pivot, and lock it.

If the user then wishes to vary the elevation of the two central wheels, he has to perform several operations requiring a long time and with the possibility of losing bushes, bolts, and pivots during these operations.

SUMMARY OF THE INVENTION

The aim of the present invention is to solve the described technical problems, eliminating the drawbacks of the known art by providing an in-line skate, that can be used both for speed skating and for slalom, where easier turning with tight curves is required.

Within the scope of this aim, an important object is to provide a skate in which the configuration for either speed skating or slalom can be achieved very quickly and easily.

Another important object is to provide a skate with an easy operation for varying the vertical alignment of the wheels and wherein chances of losing components of the skate are low.

Another object is to provide a skate which associates with the preceding characteristics that of being reliable and safe in use and has low manufacturing costs.

This aim, these objects, and others which will become apparent from the description that follows are achieved by a device for varying the alignment of wheels for in-line skates as claimed in the accompanying claims.

BRIEF DESCRIPTION OF THE DRAWINGS

Other objects will become apparent during the description that follows, which must be considered together with the accompanying drawings which illustrate by way of non-limitative example a particular embodiment and in which.

DESCRIPTION OF A PREFERRED EMBODIMENT OF THE INVENTION

Figure 1:
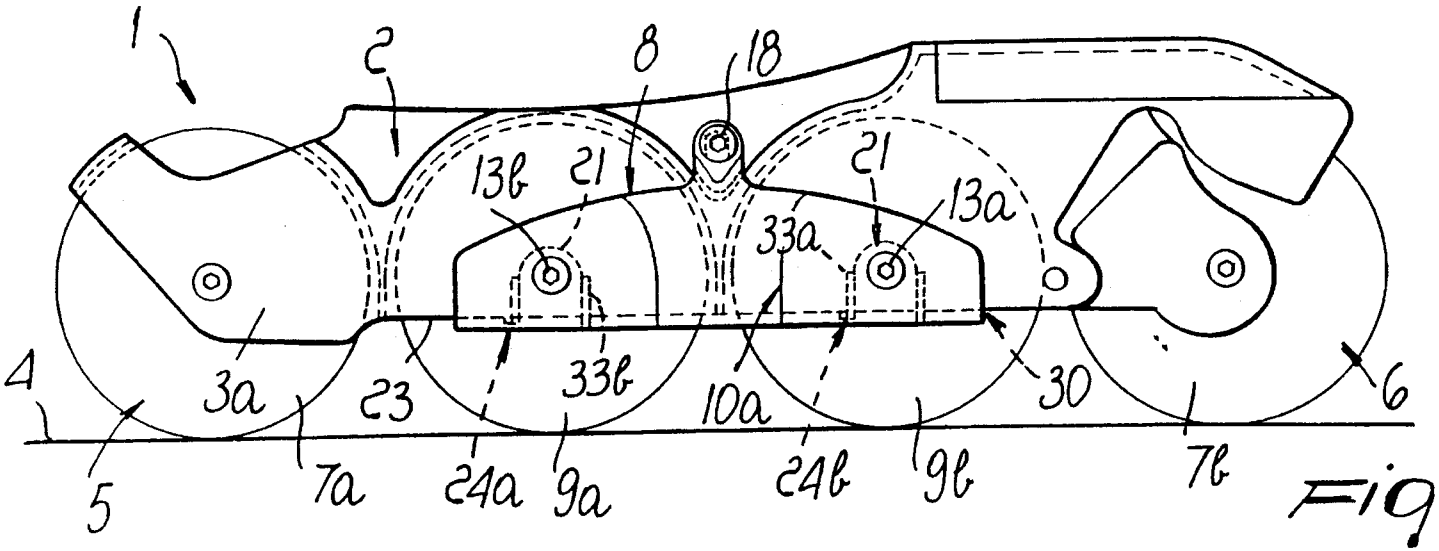
FIG. 1 is a side view of the skate with all the wheels arranged at the same elevation.

With reference to the figures, and bearing in mind that they exemplify a particular embodiment and are in variable scale and that individual numerals refer to identical or equivalent parts, the numeral 1 designates a wheel supporting device for supporting wheels for in-line skates which includes a U-shaped main frame 2 that has first wings 3*a* and 3*b* directed towards the ground 4. First mutually aligned and spread apart wheels 7*a* and 7*b* are rotatably supported by first support element between the wings at the front end 5 and at the rear end 6. The frame 2 has a longitudinal extension which extends from the front end 5 to the rear end 6.

The numeral 8 designates the device for altering the alignment of second wheels 9*a* and 9*b*. The device is constituted by an alignment-adjustable support frame constituted by two identical support sides, designated by the reference numerals 10*a* and 10*b*. In this particular embodiment one support has been illustrated but the number of supports may vary according to the needs. The supports are associated laterally and externally with respect to the first wings 3*a* and 3*b* of the frame 2 in a selected one of two positions, as will become clear hereinafter.

Each support side, 10*a* and 10*b*, is shaped essentially complementarily with respect to the first wings 3*a* and 3*b* of the frame in the region of the second wheels 9*a* and 9*b*.

Figure 2:
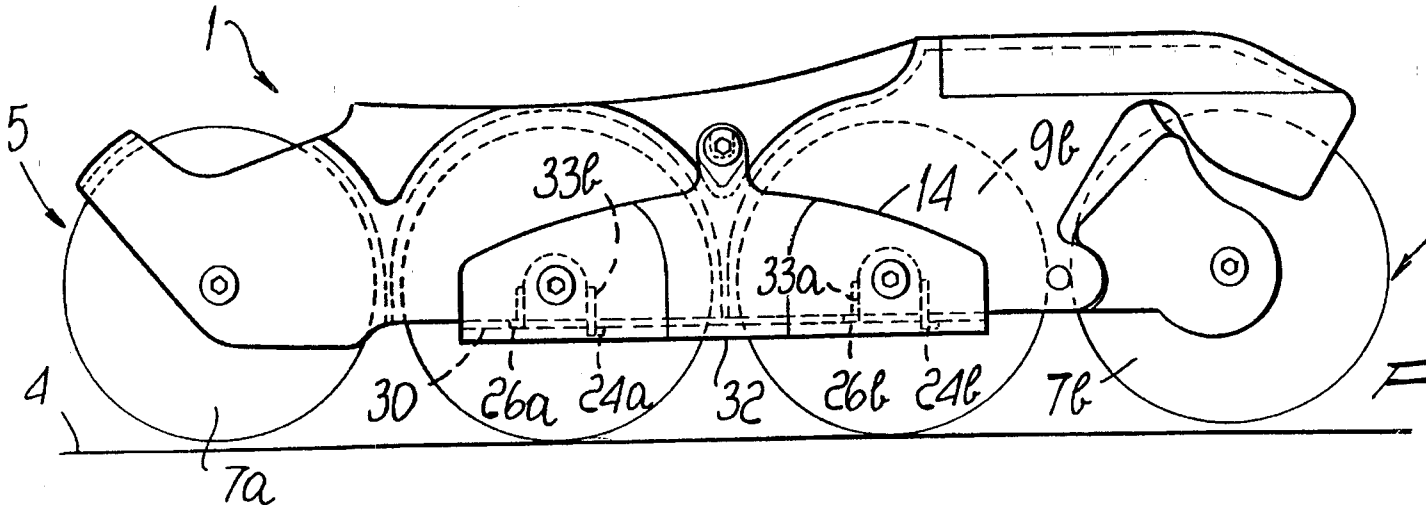
FIG. 2 is a view of the skate with its central wheels staggered with respect to the front and rear wheels.
Figure 3:
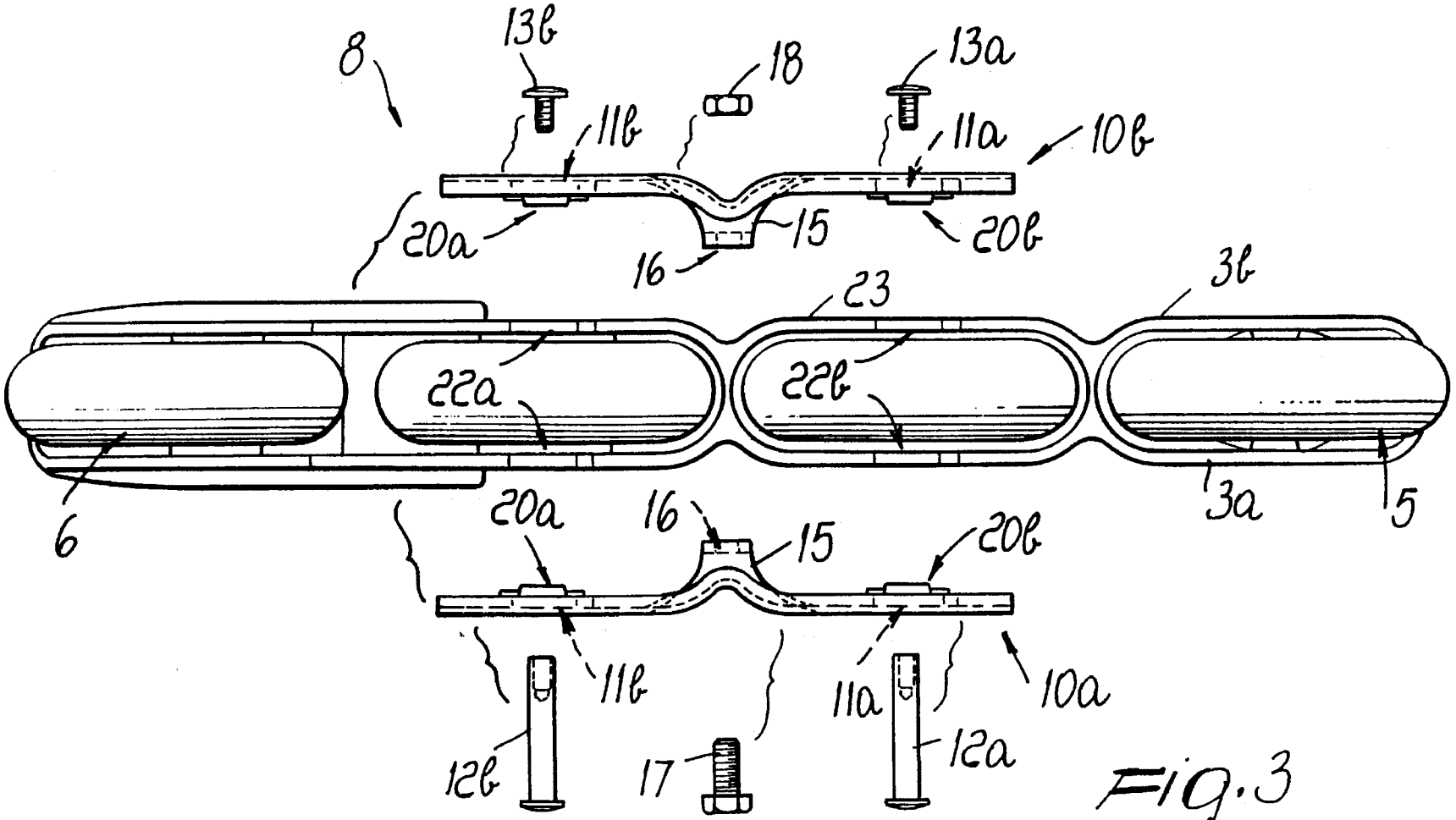
FIG. 3 is a bottom view of the skate, wherein the two supports are not associated with the wheels and the frame for the sake of clarity.
Figure 4:
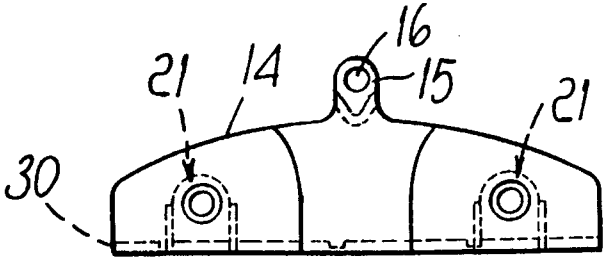
FIG. 4 is a side view of one of the supports.
Figure 5:
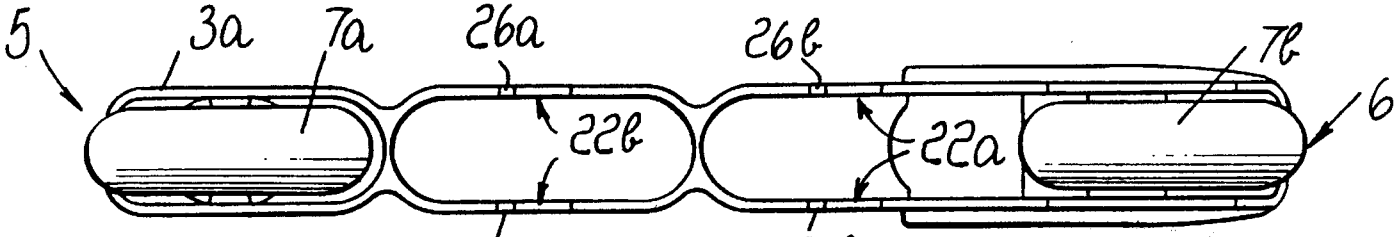
FIG. 5 is a bottom view of the frame without the supports applied to it.
Figure 6:
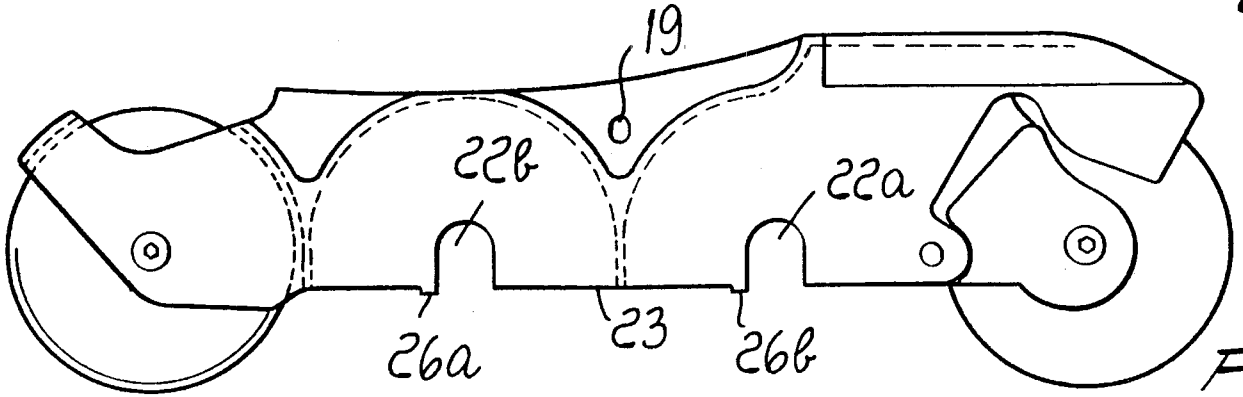
FIG. 6 is a side view of the skate without the supports.
Figure 7:
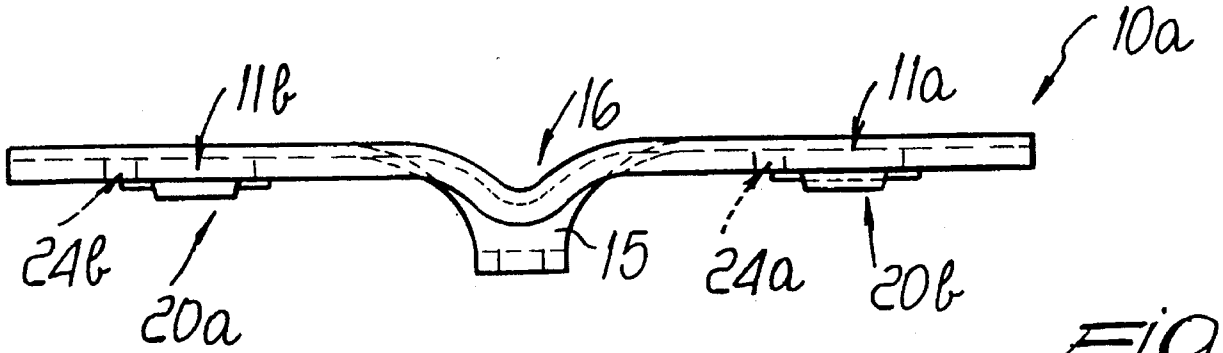
FIG. 7 is a top view of one of the supports.
Figure 8:
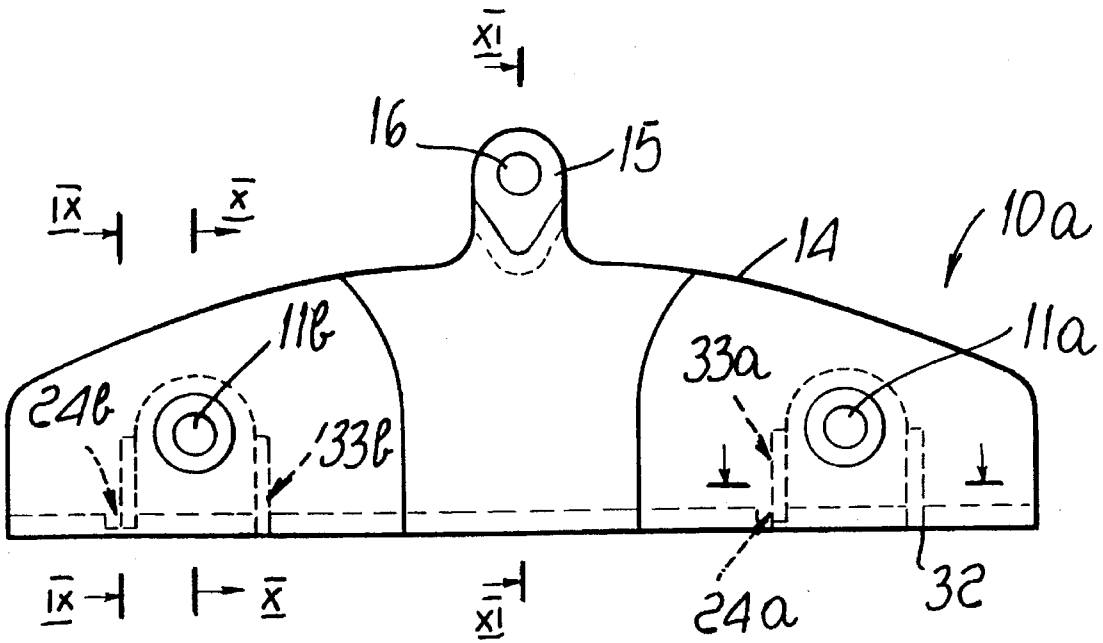
FIG. 8 is a side view of a support.
Figure 12:
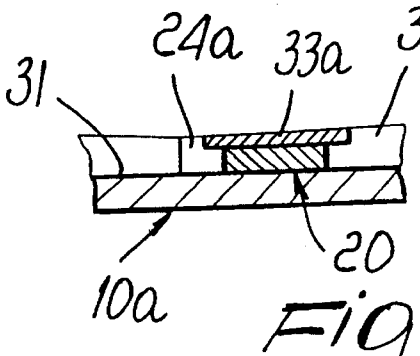
FIG. 12 is a sectional view taken along the plane XII—XII of FIG. 8.
Figure 13:
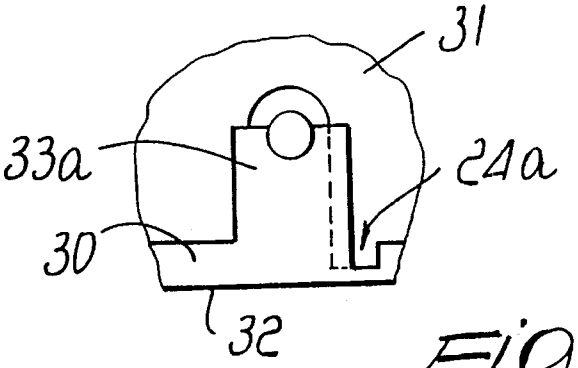
FIG. 13 is a partial view of the support of FIG. 8.
Figure 11:
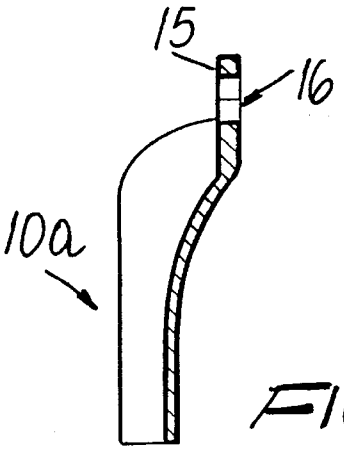
FIG. 11 is a sectional view, taken along the plane XI—XI of FIG. 8.
Figure 9:
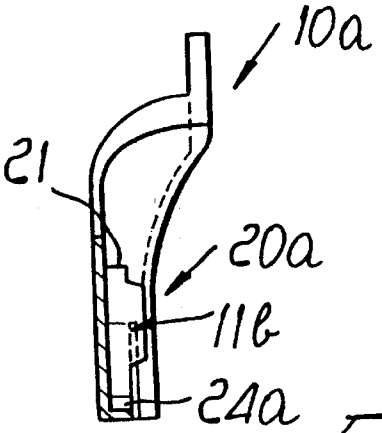
FIG. 9 is a sectional view, taken along the plane IX—IX of FIG. 8.
Figure 10:
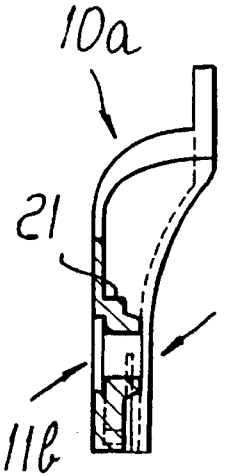
FIG. 10 is a sectional view, taken along the plane X—X of FIG. 8.

Each support thus has, in plan view, an essentially rectangular shape with chamfered or radiused edges. In this particular embodiment, there are two first holes 11*a* and 11*b* proximate to the ends of the support. These holes act as seats for adapted first screws 12*a* and 12*b* and first locking nuts 13*a* and 13*b* i.e. second support element for the pivoting of the second wheels 9*a* and 9*b* to the support sides 10*a* and 10*b*. As shown in FIGS. 1 and 2, the wheels 9*a* and 9*b* are arranged between the wheels 7*a* and 7*b* when the support frame is coupled to the main frame 2.

A tab 15 is provided at the edge 14 of each support side 10*a* and 10*b* that does not face the ground 4. The tab has a second through hole 16 which acts as seat for a bolt 17 that can be tightened by a second nut 18.

The bolt 17 is arranged at two first slots 19, formed on the first wings 3*a* and 3*b* of the frame 2 in a region that is central with respect to the arrangement of the second wheels 9*a* and 9*b*.

Alternatively, the tabs 15 can be temporarily locked with pins. Locking can also be obtained by placing the head of the tab in a suitable seat formed on the first wings of the frame. In this case, the tabs may be flexible so as to allow even faster and easier coupling and uncoupling if a monolithic support is used.

The two support sides 10*a* and 10*b* and the frame 2 have a locator and abutment means which allows, when the pair of supports is rotated after the second wheels 9*a* and 9*b* have been associated with it, a mutual and selective vertical connection that arranges the second wheels so that they are aligned or staggered with respect to the first wheels 7*a* and 7*b*.

The locator means is constituted by two raised portions 20*a* and 20*b* which protrude from each support side 10*a* and 10*b* on the surface that faces the first wings 3*a* and 3*b* of the frame 2. The two raised portions have a tip 21 directed towards the edge 14 which is preferably curved.

These two raised portions protrude from a ridge 30 which in turn protrudes at right angles from the inner lateral surface 31 of each support at the lower edge 32.

The first holes 11*a* and 11*b* are formed at these two raised portions 20*a* and 20*b*.

The abutment means provided on the frame 2 is constituted by two openings, designated by the reference numerals 22*a* and 22*b*, which are formed at each one of the first wings 3*a* and 3*b* starting from their edge 23; the wings are shaped complementarily with respect to the two raised portions 20*a* and 20*b*.

A further locator means present in the two support sides 10*a* and 10*b* is constituted by two recesses 24*a* and 24*b* which are formed at the ridge 30 at the right or left side of each raised portion 20*a* and 20*b*.

These recesses 24*a* and 24*b* interact selectively with an additional abutment means arranged on the first wings 3*a* and 3*b* of the frame 2. This additional abutment means is constituted by two first teeth 26*a* and 26*b* which protrude from the edge 23 of each one of the first wings 3*a* and 3*b* at the side of the two openings 22*a* and 22*b* that are directed towards the front end 5 of the frame 2 or at the opposite side.

There is also an additional means, constituted by two walls 33*a* and 33*b*; these walls are slightly wider than the raised portions 20*a* and 20*b* and are shallower.

Use of the device is thus as follows: first of all the second wheels 9*a* and 9*b* are associated with the supports 10*a*, 10*b*; then the support frame, with the second wheels 9*a* and 9*b* associated therewith, is inserted in the main frame 2, second wheels 9*a* and 9*b*, and the raised portions 20*a* and 20*b* fit within the openings 22*a* and 22*b*. If the support is arranged so that the teeth 26*a* and 26*b* are arranged at the recesses 24*a* and 22*b*, the first and second wheels are aligned, as shown in FIG. 1. Thus, the support plane extending tangentially to the supporting surfaces of the wheels 7*a* and 7*b* is aligned, i.e. extends substantially in the same plane, as the support plane extending tangentially to the supporting surfaces of the wheels 9*a* and 9*b*.

If the support sides are extracted and turned through 180° , parallel to the ground, the teeth instead abut against the ridge 30 and raise the frame with respect to the support, thus staggering the second wheels with respect to the first wheels. The staggered position of the wheels corresponds to a situation in which the tangential support plane of the wheels 7*a* and 7*b* is nonaligned, i.e., does not extend in the same plane, as the tangential support plane of the wheels 9*a* and 9*b*, as shown in FIG. 2.

As an alternative, It is seen that support frame, by being extracted and turned through 180° degrees, is selectively couplable to the main frame 2 in one of two positions. Thus, the frame includes a first end and a second end and an extension extending therebetween, and in the first selected position the first end of the support frame is arranged towards the front end 5 of the main frame 2 and the second end of the support frame is arranged towards the rear end of the main frame 2, while in the second selected position the first end of the support frame is arranged towards the rear end 6 of the main frame 2 and the second end of the support frame is arranged towards the front end 5 of the main frame. The first position of the support frame corresponds to the aligned state of the respective wheel tangential support planes as seen in FIG. 1, and the second position corresponds to the nonaligned state of the respective wheel tangential support planes as seen in FIG. 2. Moreover, it is seen that the recesses 24*a* and 24*b* formed at the ridges 30 of the support sides 10*a* and 10*b* of the support frame, and the teeth 26*a* and 26*b* protruding from the edges 23 of the wings 3*a* and 3*b* of the main frame 2, together form a connecting structure or means between the support frame and the main frame for selectively coupling the support frame to the main frame in either of the first and second positions the teeth can be formed on the first wings and the recesses can be formed on the frame.

It has thus been observed that the device for altering the alignment of wheels has achieved the intended aim and objects, allowing the athlete to rapidly and easily modify the skate, selectively adapting it to either speed skating and to slalom skating, which requires easier turning with tight curves.

Changing the configuration of the skate requires a very limited number of actions, and if flexible parts are used for the supports of the tabs 15, does not require the disassembly of any part and thus does not require any tool and eliminates the possibility of losing components of the skate.

The materials of which the parts of the device are made, as well as the dimensions of the individual components of the device, can of course vary according to various requirements.

I claim:

1. A wheel supporting device for supporting wheels for in-line skates, comprising:

a main frame having a pair of wings, wherein said main frame has a front end and a rear end and a longitudinal extension extending between said front and rear ends;

first support elements for rotatably supporting a pair of main wheels between said pair of wings of said main frame such that said pair of main wheels are mutually spaced apart along said longitudinal extension of said main frame, and such that a first support plane extends essentially tangentially to respective supporting surfaces of said pair of main wheels;

an alignment-adjustable support frame couplable to said main frame in a selected one of two positions, wherein said support-frame has a first end and a second end and an extension extending between said first and second ends, and wherein in a first position of said two positions said first end of said support frame is arranged towards said front end of said main frame while said second end of said support frame is arranged towards said rear end of said main frame, and wherein in a second position of said two positions said first end of said support frame is arranged towards said rear end of said main frame while said second end of said support frame is arranged towards said front end of said main frame;

second support elements for rotatably supporting at least one further wheel to said support frame such that said at least one further wheel is arranged between said pair of main wheels when said pair of main wheels are rotatably supported by said main frame and when said support frame is coupled to said main frame, and such that a second support plane extends essentially tangentially to a support surface of each said at least one further wheel; and a connecting structure for selectively coupling said support frame to said main frame selectively in either of said two positions such that in said first position said first and second support planes are substantially mutually aligned and such that in said second position said first and second support planes are mutually relatively staggered.

said support frame comprising a pair of sides, said second elements being adapted for rotatably supporting said at least one further wheel between said pair of sides of sides support frame, said pair of wings being arranged between said pair of side when said support frame is coupled to said main frame.

2. The wheel supporting device of claim 1 wherein said second support elements are adapted for rotatably supporting a pair of further wheels to said support frame such that said pair of further wheels are arranged between said pair of main wheels and such that said second support plane extends essentially tangentially to respective support surfaces of each wheel of said pair of further wheels.

3. The wheel supporting device of claim 1 wherein in said second position said second support plane lies further from said main frame than said first support plane.

4. The wheel supporting device of claim 3 wherein in said second position said support frame protrudes from said main frame with respect to a coupled position of said support frame relative to said main frame in said first position.

5. The wheel supporting device of claim 1 wherein said connecting structure comprises:

at least one tooth protruding from one of an edge of a wing of said pair of wings and of a ridge of a side of said pair of sides; and at least one recess provided in the other of said edge and said ridge;

wherein in said first position said at least one tooth is accommodated in said at least one recess such that said edge and said ridge mutually engage, and wherein in said second position said a least one tooth engages against said ridge such that said ridge and said edge are mutually spaced apart.

6. The wheel supporting device of claim 1 wherein each of said wings has an edge and each of said sides has a ridge, said connecting structure comprising a plurality of teeth each protruding from one of (a) the edges of said pair of wings and (b) the ridges said pair of sides; and a plurality of recesses provided in the other of said edges and said ridges;

wherein in said first position said teeth are accommodated in said recesses such that said edges and said ridges respectively mutually engage, and wherein in said second position said teeth engage against said ridges such that said ridges and said edges are respectively mutually spaced apart.

7. A wheel supporting device for supporting wheels for in-line skates, comprising:

a main frame having a pair of wings, wherein said main frame has a front end and a rear end and a longitudinal extension extending between said front and rear ends;

first support elements for rotatably supporting a pair of main wheels between said pair of wings of said main frame such that said pair of main wheels are mutually spaced apart along said longitudinal extension of said main frame, and such that a first support plane extends essentially tangentially to respective supporting surfaces of said pair of main wheels;

an alignment-adjustable support frame couplable to said main frame in a selected one of two positions, wherein said support frame has a first end and a second end and an extension extending between said first and second ends, and wherein in a first position of said two positions said first end of said support frame is arranged towards said front end of said main frame while said second end of said support frame is arranged towards said rear end of said main frame, and wherein in a second position of said two positions said first end of said support frame is arranged towards said rear end of said main frame while said second end of said support frame is arranged towards said front end of said main frame;

second support elements for rotatably supporting at least one further wheel to said support frame such that said at least one further wheel is arranged between said pair of main wheels when said pair of main wheels are rotatably supported by said main frame and when said support frame is coupled to said main frame, and such that a second support plane extends essentially. tangentially to a support surface of each said at least one further wheel; and connecting means for selectively coupling said support frame to said main frame selectively in either of said two positions such that in said firs position said first and second support planes are substantially mutually aligned and such that in said second position said first and second support planes are mutually relatively staggered, said connecting means comprising recess locator means and protruding abutment means provided between said main and support frames for providing said first position by having said protruding abutment means arranged in said recess locator means and for providing said second position in which said protruding abutment means are arranged outside of said recess locator means.

8. A wheel supporting device for supporting wheels for in-line skates, comprising:

an elongate main frame having a pair of wings, wherein said main frame has a front end and a rear end;

first support means for rotatably supporting a pair of main wheels between said pair of wings of said main frame such that said main wheels are spaced from one another along said main frame;

an alignment-adjustable support frame;

coupling means for selectively coupling said support frame to said main frame in either of two positions angularly spaced from one another by approximately 180°;

second support means for rotatably supporting at least one further wheel to said support frame such that said further wheel is arranged between said main wheels when said main wheels are rotatably supported by said main frame and when said support frame is coupled to said main frame; and displacement means disposed on said main frame and said support frame for disposing said further wheel at different distances from said main frame in said two positions of said support frame so that in one of said two positions said further wheel defines a common surface-engagement or support plane with said main wheels and so that in another of said two positions said further wheel is staggered with respect to said main wheels to define a surface-engagement or support plane different from a surface-engagement or support plane of said main wheels, said support frame comprising a pair of said parts and second support means being adapted for rotatably supporting said further wheel between said pair of parts of said support frame, said pair of wings being arranged between said pair of side parts when said support frame is coupled to said main frame.

9. The wheel supporting device of claim 8 wherein said displacement means comprises:

at least one tooth protruding from one of (a) an edge of a wing of said pair of wings and (b) a ridge on a side of said pair of sides; and at least one recess provided in the other of said edge and said ridge, wherein in said one of said two positions said tooth is accommodated in said recess such that said edge and said ridge mutually engage, and wherein in said other of said two positions said tooth engages against said ridge such that said ridge and said edge are spaced apart from one another.

10. A wheel supporting device for supporting wheels for in-line skates, comprising:

a main frame having a pair of wings, wherein said main frame has a front end and a rear end and a longitudinal extension extending between said front and rear ends;

first support elements for rotatably supporting a pair of main wheels between said pair of wings of said main frame such that said pair of main wheels are mutually spaced apart along said longitudinal extension of said main frame, and such that a first support plane extends essentially tangentially to respective supporting surfaces of said pair of main wheels;

an alignment-adjustable support frame couplable to said main frame in a selected one of two positions, wherein said support frame has a first end and a second end and an extension extending between said first and second ends, and wherein in a first position of said two positions said first end of said support frame is arranged towards said front end of said main frame while said second end of said support frame is arranged towards said rear end of said main frame, and wherein in a second position of said two positions said first end of said support frame is arranged towards said rear end of said main frame while said second end of said support frame is arranged towards said front end of said main frame;

second support elements for rotatably supporting at least one further wheel to said support frame such that said at least one further wheel is arranged between said pair of main wheels when said pair of main wheels are rotatably supported by said main frame and when said support frame is coupled to said main frame, and such that a second support plane extends essentially tangentially to a support surface of each said at least one further wheel; and a connecting structure for selectively coupling said support frame to said main frame selectively in either of said two positions such that in said first position said first and second support planes are substantially mutually aligned and such that in said second position said first and second support planes are mutually relatively staggered, said support frame comprising a pair of sides, said second support elements being adapted for rotatably supporting said at least one further wheel between said pair of sides of said support frame, said pair of wings are provided with at least one opening for accommodating a respective raised portion of said pair of sides.

* * * * *